US005653826A

United States Patent [19]

Koo et al.

[11] Patent Number: 5,653,826

[45] Date of Patent: Aug. 5, 1997

[54] HIGH STRENGTH DUAL PHASE STEEL PLATE WITH SUPERIOR TOUGHNESS AND WELDABILITY

[75] Inventors: Jayoung Koo; Michael John Luton, both of Bridgewater, N.J.

[73] Assignee: Exxon Research and Engineering Company, Florham Park, N.J.

[21] Appl. No.: 477,008

[22] Filed: Jun. 7, 1995

Related U.S. Application Data

[62] Division of Ser. No. 349,860, Dec. 6, 1994, Pat. No. 5,545,270.

[51] Int. Cl.[6] ..... B32B 15/18; C22C 38/12

[52] U.S. Cl. ..... 148/328; 148/682; 148/683

[58] Field of Search ..... 148/324, 320, 148/328; 428/682, 683

[56] References Cited

U.S. PATENT DOCUMENTS 4,273,838 6/1981 Biemiller ..... 420/105

*Primary Examiner*—Deborah Yee

*Attorney, Agent, or Firm*—Jay Simon

[57] ABSTRACT

A high strength steel composition comprising ferrite and martensite/banite phases, the ferrite phase having primarily vanadium and mobium carbide or carbonitride precipitates, is prepared by a first rolling above the austenite recrystallization temperature; a second rolling below the anstenite recrystallization temperature; a third rolling between the $Ar_3$ and $Ar_1$ transformation points, and water cooling to below about 400° C.

17 Claims, 5 Drawing Sheets

HIGH STRENGTH DUAL PHASE STEEL PLATE WITH SUPERIOR TOUGHNESS AND WELDABILITY

This is a division of application Ser. No. 349,860, filed Dec. 6, 1994, now U.S. Pat. No. 5,545,270.

FIELD OF THE INVENTION

This invention relates to high strength steel and its manufacture, the steel being useful in structural applications as well as being a precursor for linepipe. More particularly, this invention relates to the manufacture of dual phase, high strength steel plate comprising ferrite and martensite/bainite phases wherein the microstructure and mechanical properties are substantially uniform through the thickness of the plate, and the plate is characterized by superior toughness and weldability.

BACKGROUND OF THE INVENTION

Dual phase steel comprising ferrite, a relatively soft phase and martensite/bainite, a relatively strong phase, are produced by annealing at temperatures between the $A_{r3}$ and $A_{r1}$ transformation points, followed by cooling to room temperature at rates ranging from air cooling to water quenching. The selected annealing temperature is dependent on the the steel chemistry and the desired volume relationship between the ferrite and martensite/bainite phases.

The development of low carbon and low alloy dual phase steels is well documented and has been the subject of extensive research in the metallurgical community; for example, conference proceedings on "Fundamentals of Dual Phase Steels" and "Formable HSLA and Dual Phase Steels", U.S. Pat. Nos. 4,067,756 and 5,061,325. However, the applications for dual phase steels have been largely focused on the automotive industry wherein the unique high work hardening characteristics of this steel are utilized for promoting formability of automotive sheet steels during processing and stamping operations. Consequently, dual phase steels have been limited to thin sheets, typically in the range of 2–3 mm, and less than 10 mm, and exhibit yield and ultimate tensile strengths in the range of 50–60 ksi and 70–90 ksi, respectively. Also, the volume of the martensite/bainite phase generally represents about 10–40% of the microstructure, the remainder being the softer ferrite phase.

Consequently, an object of this invention is utilizing the high work hardening capability of dual phase steel not for improving formability, but for achieving rather high yield strengths, after the 1–3% deformation imparted to plate steel during the formation of linepipe to ≧100 ksi, preferably ≧110 ksi. Thus, dual phase steel plate having the characteristics to be described herein is a precursor for linepipe.

An object of this invention is to provide substantially uniform microstructure through the thickness of the plate for plate thickness of at least 10 mm. A further object is to provide for a fine scale distribution of constituent phases in the microstructure so as to expand the useful boundaries of volume percent bainite/martensite to about 75% and higher, thereby providing high strength, dual phase steel characterized by superior toughness. A still further object of this invention is to provide a high strength, dual phase steel having superior weldability and superior heat affected zone (HAZ) softening resistance.

SUMMARY OF THE INVENTION

In accordance with this invention, steel chemistry is balanced with thermomechanical control of the rolling process, thereby allowing the manufacture of high strength, i.e., yield strengths greater than 100 ksi, and at least 110 ksi after 1–3% deformation, dual phase steel useful as a precursor for linepipe, and having a microstructure comprising 40–80%, preferably 50–80% by volume of a martensite/bainite phase in a ferrite matrix, the bainite being less than about 50% of martensite/bainite phase.

In a preferred embodiment, the ferrite matrix is further strengthened with a high density of dislocations, i.e., $>10^{10}$ cm/cm$^3$, and a dispersion of fine sized precipitates of at least one and preferably all of vanadium and niobium carbides or carbonitrides, and molybdenum carbide, i.e., (V,Nb)(C,N) and $Mo_2C$. The very fine (≦50Å diameter) precipitates of vanadium, niobium and molybdenum carbides or carbonitrides are formed in the ferrite phase by interphase precipitation reactions which occur during austenite ferrite transformation below the $Ar_3$ temperature. The precipitates are primarily vanadium and niobium carbides and are referred to as (V,Nb)(C,N). Thus, by balancing the chemistry and the thermomechanical control of the rolling process, dual phase steel can be produced in thicknesses of at least about 15 mm, preferably at least about 20 mm and having ultrahigh strength.

The strength of the steel is related to the presence of the martensite/bainite phase, where increasing phase volume results in increasing strength. Nevertheless, a balance must be maintained between strength and toughness (ductility) where the toughness is provided by the ferrite phase. For example, yield strengths after 2% deformation of at least about 100 ksi are produced when the martensite/bainite phase is present in at least about 40 vol %, and at least about 120 ksi when the martensite/bainite phase is at least about 60 vol %.

The preferred steel, that is, with the high density of dislocations and vanadium and niobium precipitates in the ferrite phase is produced by a finish rolling reduction at temperatures between the $A_{r3}$ and $A_{r1}$ transformation points and quenching to room temperature. The procedure, therefore, is contrary to dual phase steels for the automotive industry, usually 10 mm or less thickness and 50–60 ksi yield strength, where the ferrite phase must be free of precipitates to ensure adequate formability. The precipitates form discontinuously at the moving interface between the ferrite and austenite. However, the precipitates form only if adequate amounts of vanadium or niobium or both are present and the rolling and heat treatment conditions are carefully controlled. Thus, vanadium and niobium are key elements of the steel chemistry.

DESCRIPTION OF THE DRAWINGS

FIG. 3*a* is a bright field image, and FIG. 3*b* a dark field image corresponding to FIG. 3*a*.

Figure 1:
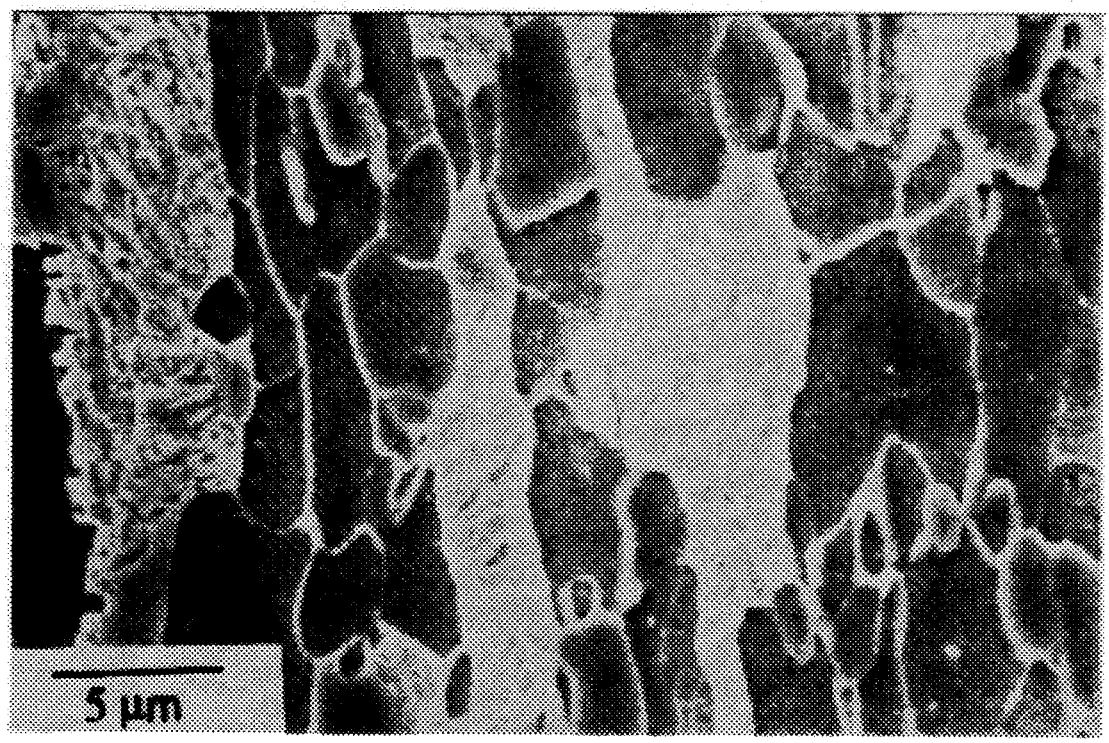
FIG. 1 shows a scanning electron micrograph revealing ferrite phase (grey) and martensite/bainite phase (brighter region) alloy A3 quench. This figure shows the final product of the dual phase steel produced in accordance with this invention.

Now, the steel of this invention provides high strength superior weldability and low temperature toughness and comprises, by weight:

0.05–0.12% C, preferably 0.06–0.12, more preferably 0.07–0.09

0.01–0.5% Si 0.4–2.0% Mn, preferably 1.0–2.0, more preferably 1.2–2.0

0.03–0.12% Nb, preferably 0.05–0.1

0.05–0.15% V 0.2–0.8% Mo 0.3–1.0% Cr, preferred for hydrogen containing environments 0.015–0.03% Ti 0.01–0.03% Al $P_{cm} \leqq 0.24$ the balance being Fe and incidental impurities.

The sum of the vanadium and niobium concentrations is ≧0.1 wt %, and more preferably vanadium and niobium concentrations each are ≧0.04%. The well known contaminants N, P, S are minimized even though some N is desired, as explained below, for producing grain growth inhibiting titanium nitride particles. Preferably, N concentration is about 0.001–0.01 wt %, S no more than 0.01 wt %, and P no more than 0.01 wt %. In this chemistry the steel is boron free in that there is no added boron, and boron concentration is ≦5 ppm, preferably <1 ppm.

Generally, the material of this invention is prepared by forming a steel billet of the above composition in normal fashion; heating the billet to a temperature sufficient to dissolve substantially all, and preferably all vanadium carbonitrides and niobium carbonitrides, preferably in the range of 1150°–1250° C. Thus essentially all of the niobium, vanadium and molybdenum will be in solution; hot rolling the billet in one or more passes in a first reduction providing about 30–70% reduction at a first temperature range where austenite recrystallizes; hot rolling the reduced billet in one or more passes in a second rolling reduction providing about 40–70% reduction in a second and somewhat lower temperature range when austenite does not recrystallize but above the $Ar_3$; air cooling to a temperature in the range between $A_{r3}$ and $A_{r1}$ transformation points and where 20–60% of the austenite has transformed to ferrite; rolling the further reduced billet in one or more passes in a third rolling reduction of about 15–25%; water cooling at a rate of at least 25° C./second, preferably at least about 35° C./second, thereby hardening the billet, to a temperature no higher than 400° C., where no further transformation to ferrite can occur and, if desired, air cooling the rolled, high strength steel plate, useful as a precursor for linepipe to room temperature. As a result, grain size is quite uniform and ≦10 microns, preferably ≦5 microns.

High strength steels necessarily require a variety of properties and these properties are produced by a combination of elements and mechanical treatments. The role of the various alloying elements and the preferred limits on their concentrations for the present invention are given below:

Carbon provides matrix strengthening in all steels and welds, whatever the microstructure, and also precipitation strengthening through the formation of small NbC and VC particles, if they are sufficiently fine and numerous. In addition, NbC precipitation during hot rolling serves to retard recrystallization and to inhibit grain growth, thereby providing a means of austenite grain refinement. This leads to an improvement in both strength and low temperature toughness. Carbon also assists hardenability, i.e., the ability to form harder and stronger microstructures on cooling the steel. If the carbon content is less than 0.01%, these strengthening effects will not be obtained. If the carbon content is greater than 0.12%, the steel will be susceptible to cold cracking on field welding and the toughness is lowered in the steel plate and its heat affected zone (HAZ) on welding.

Manganese is a matrix strengthener in steels and welds and it also contributes strongly to the hardenability. A minimum amount of 0.4% Mn is needed to achieve the necessary high strength. Like carbon, it is harmful to toughness of plates and welds when too high, and it also causes cold cracking on field welding, so an Upper limit of 2.0% Mn is imposed. This limit is also needed to prevent severe center line segregation in continuously cast linepipe steels, which is a factor helping to cause hydrogen induced cracking (HIC).

Silicon is always added to steel for deoxidization purposes and at least 0.01% is needed in this role. In greater amounts Si has an adverse effect on HAZ toughness, which is reduced to unacceptable levels when more than 0.5% is present.

Niobium is added to promote grain refinement of the rolled microstructure of the steel, which improves both the strength and the toughness. Niobium carbide precipitation during hot rolling serves to retard recrystallization and to inhibit grain growth, thereby providing a means of austenite grain refinement. It will give additional strengthening on tempering through the formation of NbC precipitates. However, too much niobium will be harmful to the weldability and HAZ toughness, so a maximum of 0.12% is imposed.

Titanium, when added as a small amount is effective in forming fine particles on TiN which refine the grain size in both the rolled structure and the HAZ of the steel. Thus, the toughness is improved. Titanium is added in such an amount that the ratio Ti/N ranges between 2.0 and 3.4. Excess titanium will deteriorate the toughness of the steel and welds by forming coarser TiN or TiC particles. A titanium content below 0.002% cannot provide a sufficiently fine grain size, while more than 0.04% causes a deterioration in toughness.

Aluminum is added to these steels for the purpose of deoxidization. At least 0.002% Al is required for this purpose. If the aluminum content is too high, i.e., above 0.05%, there is a tendency to form $Al_2O_3$ type inclusions, which are harmful for the toughness of the steel and its HAZ.

Vanadium is added to give precipitation strengthening, by forming fine VC particles in the steel on tempering and its HAZ on cooling after welding. When in solution, vanadium is potent in promoting hardenability of the steel. Thus vanadium will be effective in maintaining the HAZ strength in a high strength steel. There is a maximum limit of 0.15% since excessive vanadium will help cause cold cracking on field welding, and also deteriorate the toughness of the steel and its HAZ. Vanadium is also a potent strengthener to eutectoidal ferrite via interphase precipitation of vanadium carbonitride particles of ≦about 50Å diameter, preferably 10–50Å diameter.

Molybdenum increases the hardenability of a steel on direct quenching, so that a strong matrix microstructure is produced and it also gives precipitation strengthening on reheating by forming $Mo_2C$ and NbMo particles. Excessive molybdenum helps to cause cold cracking on field welding, and also deteriorate the toughness of the steel and HAZ, so a maximum of 0.8% is specified.

Chromium also increases the hardenability on direct quenching. It improves corrosion and HIC resistance. In particular, it is preferred for preventing hydrogen ingress by forming a $Cr_2O_3$ rich oxide film on the steel surface. As for molybdenum, excessive chromium helps to cause cold cracking on field welding, and also deteriorate the toughness of the steel and its HAZ, so a maximum of 1.0% Cr is imposed.

Nitrogen cannot be prevented from entering and remaining in steel during steelmaking. In this steel a small amount is beneficial in forming fine TiN particles which prevent grain growth during hot rolling and thereby promote grain refinement in the rolled steel and its HAZ. At least 0.001% N is required to provide the necessary volume fraction of TiN. However, too much nitrogen deteriorates the toughness of the steel and its HAZ, so a maximum amount of 0.01% N is imposed.

The objectives of the thermomechanical processing are two fold: producing a refined and flattened austenitic grain and introducing a high density of dislocations and shear bands in the two phases.

The first objective is satisfied by heavy rolling at temperatures above and below the austenite recrystallization temperature but always above the $A_{r3}$. Rolling above the recrystallization temperature continuously refines the austenite grain size while rolling below the recrystallization temperature flattens the austenitic grain. Thus, cooling below the $A_{r3}$ where austenite begins its transformation to ferrite results in the formation of a finely divided mixture of austenite and ferrite and, upon rapid cooling below the $A_{r1}$, to a finely divided mixture of ferrite and martensite/bainite.

The second objective is satisfied by the third rolling reduction of the flattened austenite grains at temperatures between the $A_{r1}$ and $A_{r3}$ where 20% to 60% of the austenite has transformed to ferrite.

The thermomechanical processing practiced in this invention is important for inducing the desired fine distribution of constituent phases.

The temperature that defines the boundary between the ranges where austentite recrystallizes and where austenite does not recrystallize depends on the heating temperature before rolling, the carbon concentration, the niobium concentration and the amount of reduction in the rolling passes. This temperature can be readily determined for each steel composition either by experiment or by model calculation.

Linepipe is formed from plate by the well known U-O-E process in which plate is formed into a U shape, then formed into an O shape, and the O shape is expanded 1–3%. The forming and expansion with their concommitant work hardening effects leads to the highest strength for the linepipe.

The following examples illustrate the invention described herein.

A 500 lb. heat of the alloy represented by the following chemistry was vacuum induction melted, cast into ingots, forged into 4 inch thick slabs, heated at 1240° C. for two hours and hot rolled according to the schedule in Table 2.

TABLE 1

| Chemical Composition (wt %) | | | | | |
|---|---|---|---|---|---|
| C | Mn | Si | Mo | Cr | Nb |
| 0.074 | 1.58 | 0.13 | 0.30 | 0.34 | 0.086 |

TABLE 1-continued

| Chemical Composition (wt %) | | | | | | |
|---|---|---|---|---|---|---|
| V | Ti | Al | S | P | N (ppm) | $P_{cm}$ |
| 0.082 | 0.020 | 0.026 | 0.006 | 0.006 | 52 | 0.20 |

The alloy and the thermomechanical processing were designed to produce the following balance with regard to the strong carbonitride formers, particularly niobium and vanadium:

about one third of these compounds precipitate in austenite prior to quenching; these precipitates provide recrystallization resistance as well as austenite grain pinning resulting in fine austenite grains before it transforms;

about one third of these compounds precipitate during austenite to ferrite transformation through the intercritical and subcritical region; these precipitates help strengthen the ferrite phase;

about one third of these compounds are retained in solid solution for precipitation in the HAZ and ameliorateing or eliminating the normal softening seen with other steels.

The thermomechanical rolling schedule for the 100 mm square initial forged slab is shown below:

TABLE 2

Starting Thickness; 100 mm
Reheat Temperature: 1240° C.
Reheating Time: 2 hours

| Pass | Thickness After Pass, mm | Temperature °C. |
|---|---|---|
| 0 | 100 | 1240 |
| 1 | 85 | 1104 |
| 2 | 70 | 1082 |
| 3 | 57 | 1060 |
| | Delay (turn piece on edge) (1) | |
| 4 | 47 | 899 |
| 5 | 38 | 866 |
| 6 | 32 | 852 |
| 7 | 25 | 829 |
| | Delay (turn piece on edge) | |
| 8 | 20 | 750 |
| | Immediately Water Quench To Room Temperature (2) | |

(1) Delay amounted to air cooling, typically at about 1° C./second.
(2) Quenching rate from finish temperature should be in the range 20 to 100° C./second and more preferably, in the range 30 to 40° C./second to induce the desired dual phase microstructure in thick sections exceeding 20 mm in thickness.

The final product was 20 mm thick and was 45% ferrite and 55% martensite/bainite.

To vary the amounts of ferrite and the other austenite decomposition products, quenching from various finish temperatures was conducted as described in Table 3. The ferrite phase includes both the proeutectoidal (or "retained ferrite") and the eutectoidal (or "transformed" ferrite) and signifies the total ferrite volume fraction. When the steel was quenched from 800° C., it was in the 100% austenite region, indicating that the $Ar_3$ temperature is below 800° C. As seen from FIG. 1, the austenite is 75% transformed when quenching from about 725° C., indicating that the $Ar_1$ temperature is close to this temperature, thus indicating a two phase window for this alloy of about 75° C. Table 3 summarizes the finish rolling, quenching, volume fractions and the Vickers microhardness data.

TABLE 3

| Dual Phase Microstructures and TMCP Practice | | | | | |
|---|---|---|---|---|---|
| Alloy (1) | Finish Roll Temp (°C.) | Start Quench Temp (°C.) | % Ferrite | % Martensite/ Bainite | Hardness (HV) |
| A1 | 800 | 800 | 0 | 100 | 260 |
| A2 | 750 | 750 | 45 | 55 | 261 |
| A3 | 750 | 740 | 60 | 40 | 261 |
| A4 | 725 | 725 | 75 | 25 | 237 |

(1) composition shown in Table 1.

Because steels having a high volume percentage of the second or martensite/bainite phase are usually characterized by poor ductility and toughness, the steels of this invention are remarkable in maintaining sufficient ductility to allow forming and expansion in the UOE process. Ductility is retained by maintaining the effective dimensions of microstructural units such as the martensite packet below 10 microns and the individual features within this packet below 1 micron. FIG. 1, the scanning electron microscope (SEM) micrograph, shows the dual phase microstructure containing ferrite and martensite for processing condition A3. Remarkable uniformity of microstructure throughout the thickness of the plate was observed in all dual phase steels.

Figure 2:
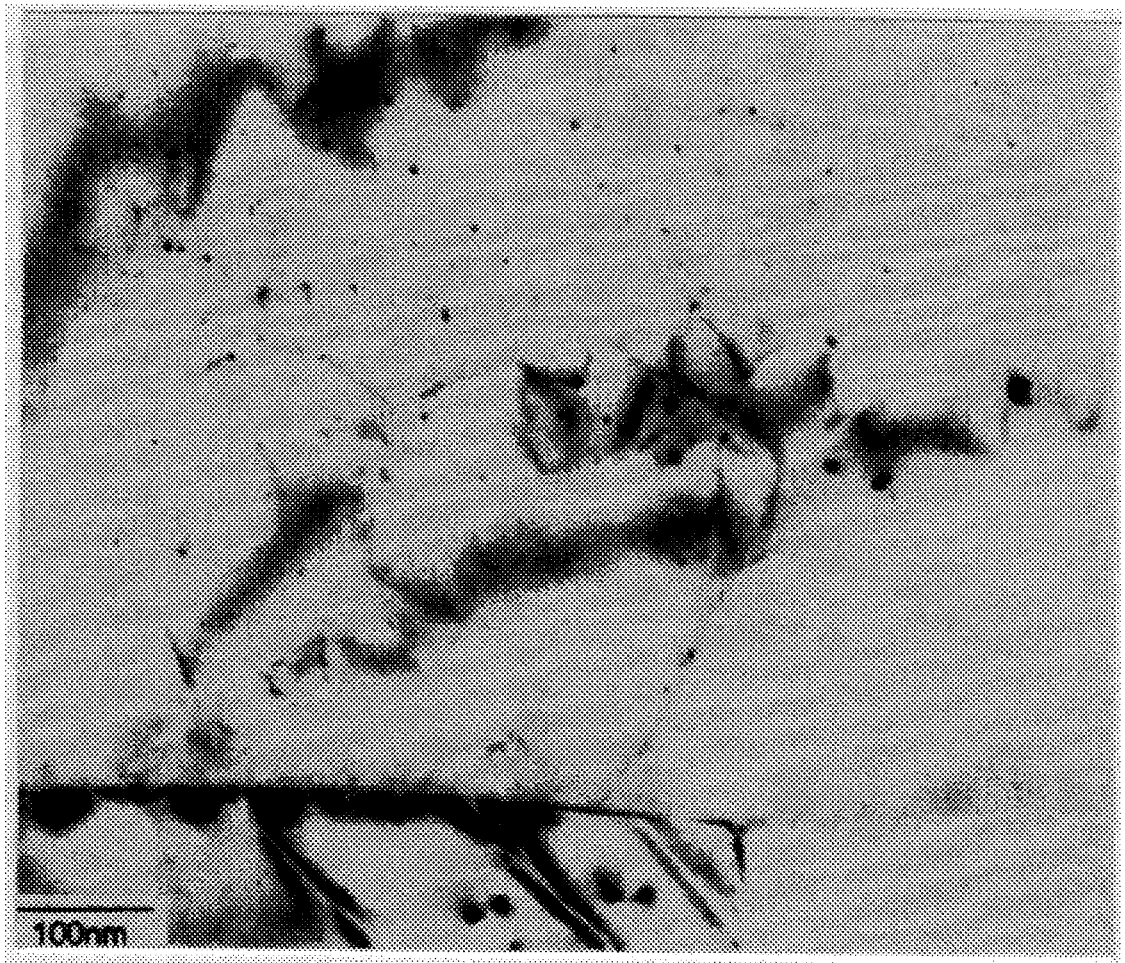
FIG. 2 shows a transmissions electron micrograph of niobium and vanadium carbonitride precipitates in the range of less than about 50Å, preferably about 10–50Å, in the ferrite phase.

FIG. 2 shows a transmission electron micrograph revealing a very fine dispersion of interphase precipitates in the ferrite region of A3 steel. The eutectoidal ferrite is generally observed close to the interface at the second phase, dispersed uniformly throughout the sample and its volume fraction increases with lowering of the temperature from which the steel is quenched.

Figure 3A:
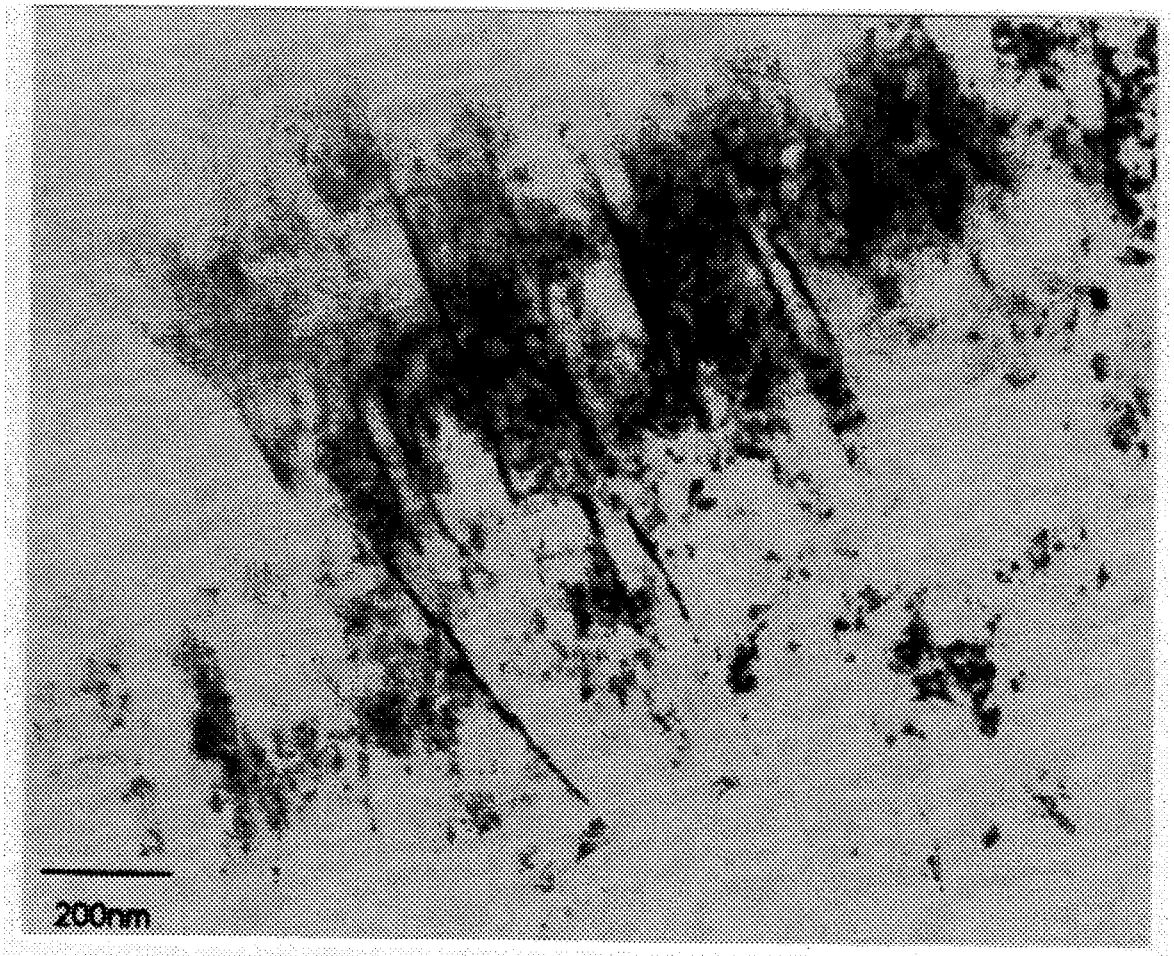
FIGS. 3*a* and 3*b* show transmission electron micrographs of the microstructural detail of the strong phase martensite.
Figure 3B:
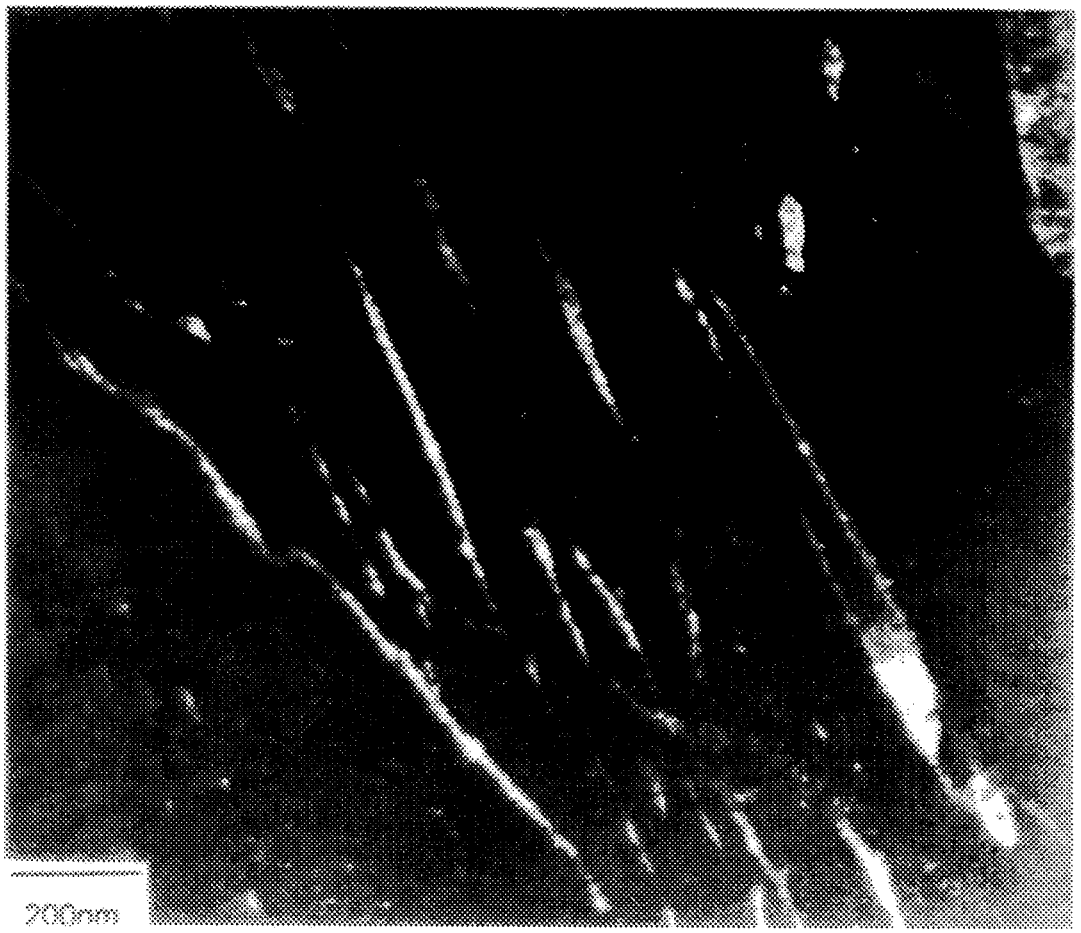

FIGS. 3*a* and 3*b* show transmission electron micrographs revealing the nature of the second phase in these steels. A predominantly lath martensitic microstructure with some bainitic phase was observed. The martensite revealed thin film, i.e., less than about 500 Å thick, retained austenite at the lath boundaries as shown in the dark field image, FIG. 3*b*. This morphology of martensite ensures a strong but also a tough second phase contributing not only to the strength of the two phase steel but also helping to provide good toughness.

Table 4 shows the tensile strength and ductility of two of the alloy A samples.

TABLE 4

| Designation | % Ferrite/ % Martensite (1) | Orientation | Tensile Strength (ksi) (2) | 0.2% Yield Strength (ksi) | Yield Strength After 2% Deformation (ksi) | % Total Elong. |
|---|---|---|---|---|---|---|
| A2 | 45/55 | Long. | 117.4 | 96.3 | 110.5 | 23.3 |
| | | Trans. | 120.1 | 87.2 | 112.2 | 19.2 |
| A3 | 60/40 | Long. | 116.3 | 79.0 | 110.0 | 25.2 |
| | | Trans. | 118.7 | 81.4 | 112.4 | 21.1 |

(1) Including small quantity of bainite and retained austenite
(2) ASTM specification E8

Yield strength after 2% elongation in pipe forming will meet the minimum desired strength of at least 100 ksi, preferably at least 110 ksi, due to the excellent work hardening characteristics of these microstructures.

Table 5 shows the Charpy-V-Notch impact toughness (ASTM specification E-23) at −40° and −76° C. performed on longitudinal (L-T) samples of alloy A4.

TABLE 5

| Alloy | % Ferrite/ % Martensite | Test Temperature (°C.) | Energy (Joules) |
|---|---|---|---|
| A4 | 75/25 | −40 | 301 |
| | | −76 | 269 |

The impact energy values captured in the above table indicate excellent toughness for the steels of this invention. The steel of this invention has a toughness of at least 100 joules at −40° C., preferably at least about 120 joules at −40° C.

Figure 4:
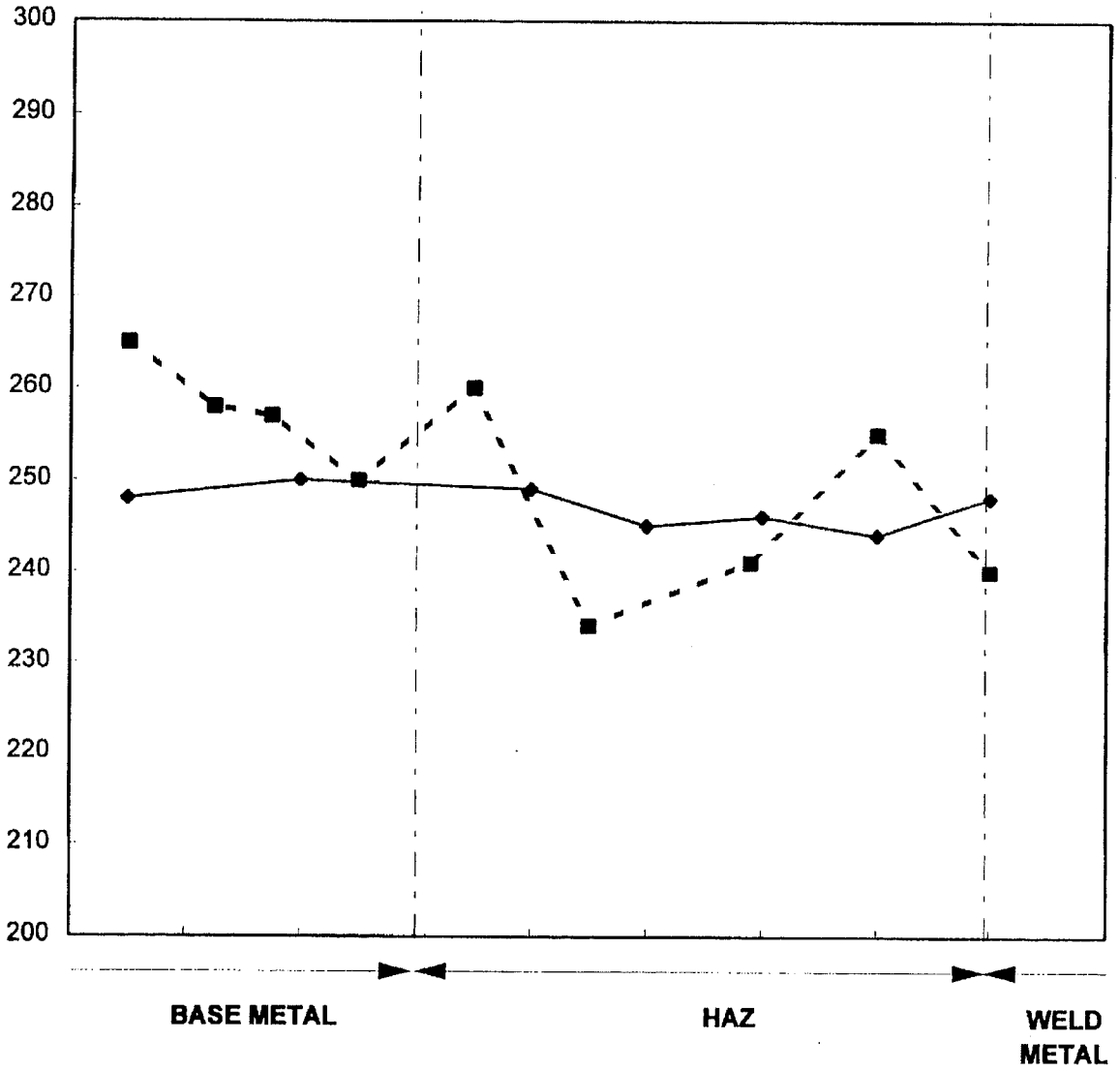
FIG. 4 shows plots of hardness (Vickers) data across the HAZ (ordinate) for the steel produced by this invention (solid line) and a similar plot for a commercial X100 linepipe steel (dotted line). The steel of this invention shows no significant decrease in the HAZ strength, whereas a significant decrease, approximately 15%, in HAZ strength (as indicated by the Vickers hardness) occurs for the X100 steel.

A key aspect of the present invention is a high strength steel with good weldability and one that has excellent HAZ softening resistance. Laboratory single bead weld tests were performed to observe the cold cracking susceptibility and the HAZ softening. FIG. 4 presents an example of the data for the steel of this invention. This plot dramatically illustrates that in contrast to the steels of the state of the art, for example commercial X100 linepipe steel, the dual phase steel of the present invention, does not suffer from any significant or measurable softening in the HAZ. In contrast X100 shows a 15% softening as compared to the base metal. By following this invention the HAZ has at least about 95% of the strength of the base metal, preferably at least about 98% of the strength of the base metal. These strengths are obtained when the welding heat input ranges from about 1–5 kilo joules/mm.

What is claimed is:

1. A dual phase steel composition comprising a ferrite phase and about 40–80 vol % of a martensite/bainite phase of which bainite is no more than about 50 vol %, the ferrite phase containing carbide or carbonitride precipitates of vanadium, mobium, molybdenum and mixtures thereof of ≦50 Angstroms diameter, the martensite/bainite phase containing retained films of austenite of less than 500 Angstroms thickness, and the sum of the vanadium and niobium concentrations is ≧0.1 and not more than 0.27 wt %.

2. The steel of claim 1 having a thickness of at least 15 mm with a uniform microstructure through thickness.

3. The steel of claim 1 which upon heating by welding thermal cycles forms additional carbide or carbonitride precipitates of vanadium, niobium or molybdenum.

4. The steel of claim 3 wherein welding heat inputs range from about 1 k joule/mm to 5 k joules/mm.

5. A welded steel composition comprising a base metal and an HAZ in which the strength of the HAZ is no less than about 95% of the strength of the base metal the base metal containing a ferrite phase and about 40–80 vol % of a martensite/bainite phase of which bainite is no more than about 50 vol %, the ferrite phase containing precipitates of vanadium, niobium, molybdenum or mixtures thereof of ≦50 Angstroms diameter, the martensite/bainite phase containing retained films of austenite of less than 500 Angstroms thickness, and the sum of the vanadium and niobium concentrations in the base metal is ≧0.1 and not more than 0.27 wt %.

6. The welded steel of claim 5 wherein the strength of the HAZ is no less than 98% of the strength of the base metal.

7. The steel of claim 6 wherein the chemistry in wt % is:

0.05–0.12 C 0.01–0.50 Si 0.4–2.0 Mn 0.03–0.12 Nb 0.05–0.15 V 0.2–0.8 Mo 0.015–0.03 Ti 0.01–0.03 Al

Pcm<0.24 the balance being Fe.

8. The steel of claim 7 wherein the sum of the vanadium and niobium concentrations is ≧0.1 wt %.

9. The steel of claim 7 wherein the steel contains 0.3–1.0% Cr.

10. The composition of claim 1 wherein the martensite/bite phase is about 50–80 vol %.

11. The composition of claim 1 wherein the martensite/bainite phase is contained in a ferrite matrix.

12. The composition of claim 1 containing no added boron.

13. The composition of claim 1 wherein the chemistry in wt % is:

0.05–0.12 C 0.01–0.50 Si 0.4–2.0 Mn 0.03–0.12 Nb 0.05–0.15 V 0.2–0.8 Mo 0.015–0.03 Ti 0.01–0.03 Al

Pcm≦0.24 the balance being Fe.

14. The composition of claim 1 containing 0.3–1.0 wt % Cr.

15. The composition of claim 5 wherein the martensite/bainite phase is 50–80 vol %.

16. The composition of claim 5 wherein the base metal contains no added boron.

17. The composition of claim 5 containing 0.3–1.0 wt % Cr.

* * * * *